United States Patent [19]

Cudzik

[11] 4,162,743

[45] Jul. 31, 1979

[54] TAB SYSTEM

[75] Inventor: Daniel F. Cudzik, Richmond, Va.

[73] Assignee: Reynolds Metals Company, Richmond, Va.

[21] Appl. No.: 926,669

[22] Filed: Jul. 21, 1978

Related U.S. Application Data

[62] Division of Ser. No. 865,447, Dec. 29, 1977, Pat. No. 4,130,074.

[51] Int. Cl.[2] ..... B65D 41/32

[52] U.S. Cl. ..... 220/270

[58] Field of Search ..... 220/266–274

[56] References Cited

U.S. PATENT DOCUMENTS 3,977,561 8/1976 Strobe et al. ..... 220/269

4,024,981 5/1977 Brown ..... 220/269

*Primary Examiner*—George T. Hall

*Attorney, Agent, or Firm*—Glenn, Lyne, Girard, Clark & McDonald

[57] ABSTRACT

A method of manufacturing a tab (43) of the type attachable to an easy-open contained wall to initiate severance of a tear panel of the contained wall, including an initial step of placing a protruding stitch (45) in a sheet metal strip (47) from which the tab is to be formed. Thereafter, a tab blank (51) is cut in the strip of sheet metal, with this cut starting and ending immediately adjacent to opposite sides of the stitch, but the cutting die is separated slightly from the stitch. Thereafter, the outer periphery (61) of the tab blank is curled onto the inner surface of the tab blank. The stitch is then severed adjacent the tab.

5 Claims, 8 Drawing Figures

TAB SYSTEM

This application is a division, of Ser. No. 865,447 filed Dec. 29, 1977, now Pat. No. 4,130,074.

This invention relates broadly to the art of fragible container walls, and more specifically to tabs of the type attached to easy-open container walls to initiate severance of tab panels of the container walls.

An easy-open container typically includes a container wall, a primary line of weakness in the container wall defining a tear panel which is at least partially removeable from the container wall, and a tab connected to, or adjacent to, the tear panel by suitable attaching means, such as a rivet, to initiate severance of the tear panel from the container wall. Such container systems are particularly well known, for example, in the easy open beer and soft drink field.

In manufacturing the tabs of the above mentioned patents and application, a difficulty has been encountered during the steps of cutting out tab blanks from sheet metal and thereafter folding the peripheral edges of the tab blanks onto the inner-surfaces of the tab blanks. In this respect, a tab blank is normally substantially cut from sheet metal but is left attached to the sheet metal by a small web or "carry" for the performance of the remaining cutting and curling operations. To initiate the manufacturing process, portions of the sheet metal adjacent to the web are cut out in order to define the sides of the web. The severed portions are known as slugs. During a subsequent step the tab blank is cut around most of its periphery from the sheet metal, with the cut extending from an opening left by the slug on one side of the web to the opening left by the slug on the other side of the web. Such a method allows the tab blank to be cut without the cutter impinging on the web and thereby damaging the web or causing the web and its attached tab-blank to rotate or otherwise move. However, this system of manufacture has also created problems in that the slugs, in spite of efforts to blow them aside, may occasionally fall into the cutting and curling dies, and damage, or otherwise disturb, the operation of the dies. Thus, periodically the dies must be taken out of operation and cleaned with pressurized air or otherwise. Therefore, it is an object of this invention to provide a method of manufacturing tabs which does not create slugs.

In the manufacture of tabs using the prior art method described above, once the tab blank has been cut out its peripheral edge is curled over onto its inner surface. However, at the web and the openings to the sides of the web, there is no peripheral edge to curl over, thus, a large gap is created in the curled peripheral edge at the web. This gap is larger than desirable because of the existence of openings on either side of the web. This creates a twofold disadvantage in that the curled peripheral edge, which strengthens the tab, cannot extend across the gap, and a wide gap exposes its pointed side edges to contact with a user's finger. Therefore, it is yet another object of this invention to provide a method for manufacturing tabs with a smaller gap in the curled peripheral edge thereof than is produced by prior art methods of manufacture. It is a further object of this invention to provide a method of manufacturing tabs which is relatively inexpensive and relatively uncomplicated.

In the above-described systems wherein slugs are produced, the punches that are used to produce the slugs must be frequently replaced. This results in both machine-down-time and the expense of replacing the punches themselves. An advantage of the instant invention, therefore, is that the previously-required slug punches do not have to be replaced.

In the slug-producing machines it was customary to blow the slugs away from the sheet metal by means of air pressure. Another advantage of the instant invention, therefore, is that it does not require either an air supply or its related equipment. In this respect, the air that was formerly blown against the sheet metal strip tended to evaporate solvents from lubricants applied to the strip prior to the progressive die operations. Hence, the lubricants did not function as well as intended; and, subsequent curling operations suffered accordingly. Another advantage of the instant invention, therefore, is that the sheet metal strip is better lubricated during the curling operations.

Still another advantage of the invention is that it permits the tab dies to operate at a faster speed. A typical prior-art-type die, for example, operated at about 450 strokes per minute whereas the method of the invention permits corresponding dies to operate at about 600 strokes per minute.

SUMMARY

According to principles of this invention, a main web between a tab-blank and a metallic sheet from which it is cut is formed by first making a protruding stitch in the metallic sheet. A tab blank is then cut from the metallic sheet with the ends of the cut being positioned on opposite sides of the stitch, but the cutting die itself is spaced from the sides of the stitch. The peripheral edge of the tab blank is then curled in the manner of the prior art, but the lack of voids permits better control of the curled metal adjacent the stitch. This leaves the stitch as the main web or "CARRY" and only a small gap between the adjacent curled portions. In this manner, a tab can be made which has a smaller gap in the curled peripheral edge thereof than was normally possible for such tabs in the prior art.

BRIEF DESCRIPTION OF THE DRAWINGS

The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
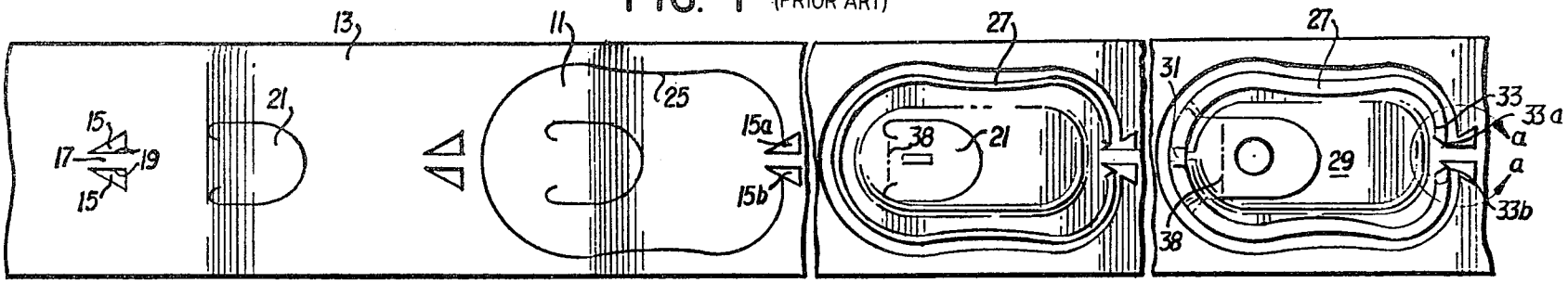
FIG. 1 (PRIOR ART)
FIG. 1 is a broken, bottom view of a strip of sheet metal from which tabs are being cut in a series of sequential steps, in accordance with principles of the prior art.
Figure 3:
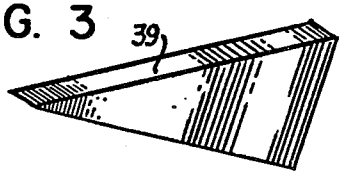
FIG. 3 is an isometric view of a slug which was generated during the sequence of steps performed on the strip of sheet metal of FIG. 1.
Figure 2:
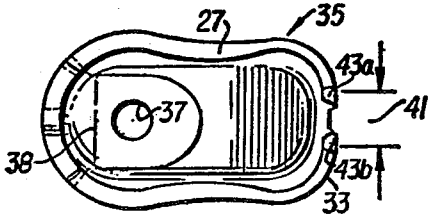
FIG. 2 is a bottom view of a tab made in accordance with the sequence of steps depicted in FIG. 1.

In a prior art system of manufacturing tabs, (such as disclosed in U.S. Pat. No. 3,967,752 to Cudzik) tab blanks 11 are cut from a sheet-metal strip 13 as depicted in FIGS. 1, 2, and 3. In this respect, the first step of cutting a tab blank 11 involves the step of cutting out two triangular-shaped openings 15 opposite one another to define a web 17 having parallel sides 19.

In a subsequent step, a generally U-shaped connecting component 21 is cut into the sheet metal strip 13.

In a subsequent step, a tab blank 11 is cut into the sheet-metal strip 13 with a cut 25 extending from the first triangular-shaped opening 15*a* to the second triangular-shaped opening 15*b*. Thus, the cutting die making the cut 25 is prevented from impinging on the web 17 and thereby possibly damaging the web or rotating the tab blank attached thereto.

In subsequent steps, the peripheral edge 27 of the tab blank 11 is curled downwardly (upwardly as seen in the bottom view of FIG. 1) by a curling die or dies to be approximately perpendicular with the main body of the tab blank 11.

Thereafter, an insert 29 is positioned on the bottom surface of the tab blank 23 so as to cover the connecting component 21 and the peripheral edge 27 is thereafter curled onto the bottom surface of the tab blank 11 to crimp the insert 29 thereto and to add strength to tab. A depending lobe 31 is imprinted onto the curled peripheral edge 27 to impinge on an end wall of a container when a lifting end 33 of a completed tab 35, FIG. 2, is lifted. In this respect, the completed tab 35 is riveted to a container wall at an opening 37 cut in the connecting component 21 and the insert 29 with its bottom side against the container wall so that when the lifting end 33 is lifted the tab pivots about a hinge zone 38 (indicated by a dashed line) to drive the depending lobe 31 into a portion of the container wall and open the tear panel thereof. The hinge zone 38 is reinforced by the insert 29. Again, it should be kept in mind that the FIG. 2 view is a bottom view.

A disadvantage with the prior-art method (and tabs created thereby) of FIG. 1–3 is that it creates large numbers of triangular slugs 39 (FIG. 3) which are cut from the openings 15. These slugs are customarily blown away by air at the rate of about $7FT^3$/min, but some fall into the dies and other equipment and tend to interfere with further production as noted above. These slugs, therefore, must be periodically cleaned from the machines which is a costly operation.

In addition, because of the existence of the openings 15, there is a relatively large gap 41 between corners 43*a* and *b* of the curled peripheral edge 27. It is this portion of the tab 35 at which a user places his finger to lift the lifting end 33 of the tab; and, because of the relatively large gap 41, a portion of the user's finger can move between the gap 41 and therefore be cut on the corners 43*a* or *b*. This is true even though during manufacture of the tab these corners are peened against the bottom surface of the tab 35.

Figure 1A:
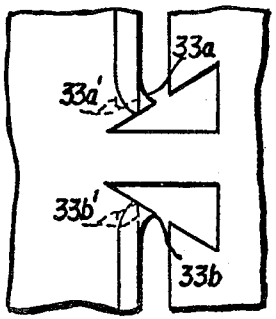
FIG. 1*a* is an enlarged fragmentary view of the FIG. 1 tab taken along the arc a—a thereof.

Also, the relatively large gap 41 reduces the strength of the tab 35; and, perhaps more importantly, the curl at areas 33*a* and 33*b* of the tab are not properly controllable as shown in FIG. 1A, for example. That is, the areas 33*a* and 33*b* tend to uncontrollably flare outwardly as shown, rather than being formed along the desired lines shown as 33*a*′ and 33*b*′.

Figure 4:
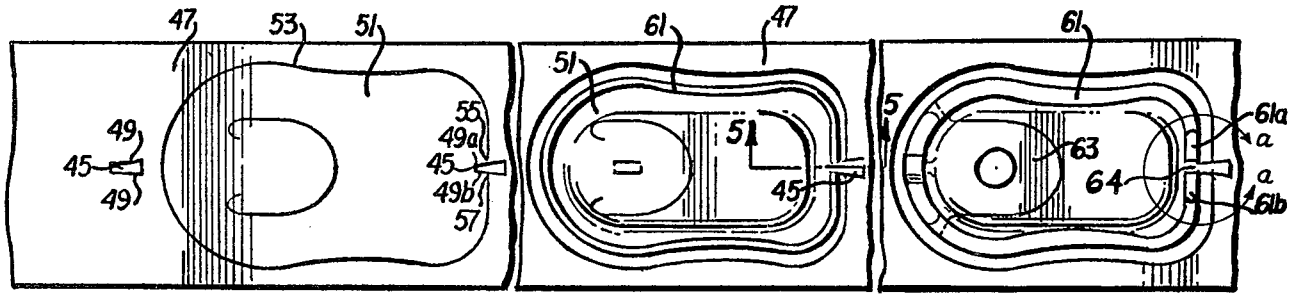
FIG. 4 is a bottom view of a strip of sheet metal having a tab made therefrom in a sequence of steps in accordance with this invention.
Figure 6:
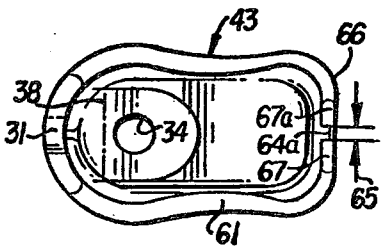
FIG. 6 is a bottom view of a tab constructed in accordance with the steps performed on the strip of sheet metal of FIG. 4.
Figure 5:
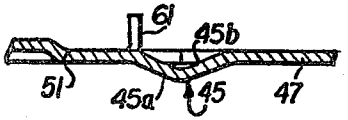
FIG. 5 is a view taken on line 5—5 in FIG. 4.

FIGS. 4, 5, and 6 depict a superior method of manufacture which produces an improved tab 43.

More specifically, a first step of manufacture involves the production of a trapezoidally shaped stitch 45 in a strip of sheet metal 47. The stitch 45 is bounded by shear-cut edges 49 and the stitch 45 itself is indented upwardly about 0.0127 mm away from the main plane of the sheet-metal strip 47 as can best be seen in FIG. 5. As used herein a "stitch" is defined as a web of metal cut in a metallic sheet, but remaining attached to the metallic sheet at opposite ends, without the removal of portions of the metallic sheet on the side of the web. It will be readily appreciated by those skilled in the art that the stitch 45 depicted in the drawings is produced by a male protruding die cooperating with a female die (not shown).

The outward-slant of each side of the trapezoidal stitch 45 should be at least 3.5° (a total angle of 7°) with respect to the center line of the strip of sheet metal 47 and preferably on the order of 10° (a total angle of 20°) in order that the male die may be easily self-removing from the shear-cut edges 49 without requiring the use of an auxiliary withdrawal means. Additionally, as will become more clear later, the stitch should preferably be formed in the direction opposite to that of a curled peripheral edge 61 (corresponding to edge 27 in the structure of FIGS. 1 and 2).

In a subsequent step a tab blank 51 is cut in the sheet-metal strip 47 with a cut 53 extending from a point 55 immediately adjacent the shear edge 49*a* of the stitch 45 to a point 57 which is adjacent to the opposite shear edge 49*b*.

Figure 4A:
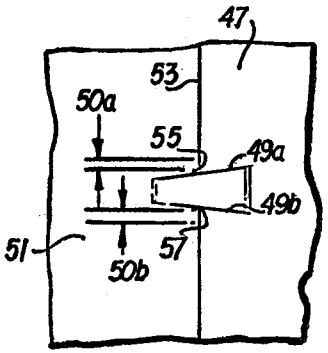
FIG. 4*a* is an enlarged fragmentary view of a stitch portion of FIG. 4 during one of the tab's process steps and taken along the arc a—a of FIG. 4.

The die (not shown) for bringing the cut 53 to points 55 and 57 does not actually extend to the shear cuts at 49*a* and *b*, but rather is spaced therefrom by distances 50*a* and 50*b* of 0.0038 cm. in a preferred embodiment (FIG. 4*a*). By making the die so that it does not extend to the shear-edge cuts 49*a* and *b*, it is insured that neither side of the cutting die impinges on the stitch 45 or damages the stitch or causes the stitch 45, and its attached tab blank 51, to rotate or otherwise move.

Thereafter, a peripheral outer edge 61 of the tab blank 51 is curled downwardly by dies, as is depicted in FIGS. 4 and 5. During the curling step the stability added by the lack of the prior-art voids permits the configuration of the curl to be accurately controlled to provide a smooth curve as illustrated at 61*a* and 61*b* of FIG. 4. This, therefore, avoids the undesirable pointed extensions 33*a* and 33*b* of the FIGS. 1 and 1A embodiment's curls.

When the stitch 45 is formed, the width of the lower edge 45*a* is naturally greater than its upper edge 45*b*. Consequently, by forming the stitch 45 in the direction opposite from the subsequent direction-of-curl of portions 61*a* and 61*b*, interference is avoided during the curling operation between the stitch 45 and the curled portions 61*a* and 61*b*. Consequently, metal shear particles are avoided and not available to foul the cutting dies and the like.

Finally, an insert 63 is added; the peripheral outer edge 61 is fully crimped down on the bottom surface of the tab blank 51; and, the stitch 45 is severed at its attachment 64 to the sheet-metal strip 47. The slight end of the stitch 64*a* remaining on the tab, however, is bent upwardly slightly toward the center of gap 65 so that the severed edge 64*a* is protected by the sides of the gap and not exposed.

The improved tab 43 is similar to the prior-art tab of FIG. 2 in that it has most of the same structure thereas, such as a depending lobe 31, a lifting end 66, an attachment apperture 34, and a hinge zone 38, as well as other structure not specifically mentioned herein. However, it is superior to the tab of FIG. 2 in that a gap 65 formed in its curled peripheral outer edge 61 is much smaller than the gap 41 of the prior-art tab of FIG. 2. The smallness of the gap 65 makes it difficult for a person's skin to undesirably engage corners 67 of the gap once they have been peened as at 67*a*. Also, since the curled peripheral outer edge 61 extends a greater distance thereround to create the smaller gap, it provides increased strength for the improved tab 43; and, in addition, sharp points such as 33*a* and 33*b* have been eliminated.

Still an additional benefit of the method of FIGS. 4 and 5 is that there are no slugs such as the slug 39 of FIG. 3 to interfere with dies or other machinery constructing the improved tab 43. This, as indicated above, results in a savings in pressurized air equipment; better lubrication because lubricant solvents are not evaporated by such air; a reduction in punch replacement costs; and a reduction in down-time for either clearing slugs from the machine or replacing punches. In this respect, a prototype of a machine for practicing a preferred embodiment of the invention produced over 10 million consecutive tabs without any down-time.

In a preferred embodiment, the trapezoidally-shaped stitch 45 is 0.334 cm long and, where it is attached to the tab blank 51 it is approximately 0.107 cm wide. At the wider portion, where it is attached to the sheet-metal strip 47, it is 0.225 cm wide. In a preferred embodiment, the gap 65 is approximately 0.142 cm wide. This gap should preferably not be wider than 0.200 cm in order to prevent the possibility of damaging a user's skin.

While a present preferred embodiment of the invention has been illustrated and described, it may otherwise be variously embodied and practiced within the scope of the following claim:

I claim:

1. In a tab comprising a body having an inner surface to be mounted facing a container wall, said container wall having a tear panel therein, an outer surface to be mounted facing away from said container wall, a lifting end to be lifted away from the container wall to sever said tear panel, an attachment portion for fastening said tab to said container wall and for allowing pivotal movement of said tab when said lifting end is lifted and a forward end for impinging with force on said container wall and tab dab is thereby caused to pivot, the improvement comprising an end portion of a severed stitch affixed to an end of said tab, said stitch being located between the ends of an outer peripheral edge of the body which is curled onto the inner surface thereof except at a gap formed at said stitch and wherein said gap is equal in width to the width of said stitch.

2. The tab of claim 1 wherein said gap has a width of less than about 0.200 cm.

3. A tab as in claim 2 wherein said gap is approximately 0.142 cm.

4. The tab as in claim 1 wherein said curled peripheral edge is peened at said gap.

5. The tab of claim 1 wherein said end portion of said severed stitch is bent toward said gap.

* * * * *